US006907766B2

(12) United States Patent
Garrett, Jr. et al.

(10) Patent No.: US 6,907,766 B2
(45) Date of Patent: Jun. 21, 2005

(54) LIP FORMING TOOL FOR FIREARM MAGAZINES

(76) Inventors: Sandy Alexander Garrett, Jr., 7518 K Fullerton Rd., Springfield, VA (US) 22153; Robert Hudson Garrett, 7518 K Fullerton Rd., Springfield, VA (US) 22153

( * ) Notice: Subject to any disclaimer, the term of this patent is extended or adjusted under 35 U.S.C. 154(b) by 73 days.

(21) Appl. No.: 10/409,331

(22) Filed: Apr. 8, 2003

(65) Prior Publication Data

US 2003/0188567 A1 Oct. 9, 2003

Related U.S. Application Data

(60) Provisional application No. 60/371,024, filed on Apr. 9, 2002.

(51) Int. Cl.[7] ..... B21J 9/18

(52) U.S. Cl. ..... 72/454; 72/414; 72/475

(58) Field of Search ..... 72/379.2, 412, 72/414, 470, 475, 454; 42/49.01, 50

(56) References Cited

U.S. PATENT DOCUMENTS

| | | | | | |
|---|---|---|---|---|---|
| 3,460,372 | A | * | 8/1969 | Bartz et al. | 72/454 |
| 3,482,322 | A | | 12/1969 | Ito | |
| 3,564,949 | A | | 2/1971 | Hedrick | |
| 3,564,950 | A | | 2/1971 | Jorczak | |
| 3,939,590 | A | | 2/1976 | Musgrave | |
| 4,483,060 | A | | 11/1984 | Farrar et al. | |
| 4,519,235 | A | * | 5/1985 | Gauck | 72/414 |
| 4,700,500 | A | | 10/1987 | Slappy, Jr. | |
| 4,819,289 | A | | 4/1989 | Gibbs | |
| 5,048,214 | A | | 9/1991 | Cohen | |
| 5,159,136 | A | | 10/1992 | Marsh | |
| 5,168,648 | A | * | 12/1992 | Brandl et al. | 42/50 |
| 5,287,720 | A | * | 2/1994 | Lishness | 72/379.2 |
| 5,329,718 | A | * | 7/1994 | Howard | 42/50 |
| 5,337,505 | A | | 8/1994 | Brown et al. | |
| 5,416,940 | A | | 5/1995 | Bandera | |
| 5,417,003 | A | | 5/1995 | Claveau | |
| 6,234,000 | B1 | * | 5/2001 | Bowling | 72/370.23 |

* cited by examiner

*Primary Examiner*—Ed Tolan

(57) ABSTRACT

The present invention relates to the field of tools used to modify the magazines of firearms. A die and anvil are configured to engage and form the lips of magazines, like that of the M16A4 and M4A1, to correct damage and enhance the feed angle of rounds to improve feeding and accuracy. The die and anvil are provided with a means to align them during the forming process to minimize the attempts necessary to complete the forming process. The anvil is configured to enter from the base of a magazine and to engage the side walls with sufficient tolerance to allow for free movement, but tight enough to detect deformation in the side walls. The anvil can be used as a rigid surface to correct deformation of the side walls with a non-marring tool. The preferred embodiment provides sufficient force to form the feed lips of the magazine without the need for additional tools.

4 Claims, 2 Drawing Sheets

LIP FORMING TOOL FOR FIREARM MAGAZINES

This application claims the benefit of U.S. Provisional application No. 60/371,024, filed Apr. 9, 2002.

BACKGROUND OF THE INVENTION

1. Field of the Invention

The present invention relates to the field of tools used to modify the magazines of firearms.

The use of tools or dies to modify the feed lips of magazines for firearms is known. Firearms magazines are provided with feed lips to hold rounds of ammunition in the magazine and to station the rounds at a proper angle for feeding of the rounds into the chamber by the bolt or slide of the firearm.

The feed lips also control the release of the rounds from the magazine. The timing of the release of the round from the magazine is critical to the proper functioning of the firearm.

Tools or forming dies have been manufactured to create a consistent release point in the magazines of pistols like the M1911A1. The lips of issue magazines of the M1911A1 are made with a "gradual taper" release configuration. The release of the rounds in these magazines varies considerably and anvil/die tools, such as that manufactured by Novak's of Parkersburg, W.Va., have been designed to form a consistent point of release at a predetermined point, at the same location, of both feed lips. This consistent release point improves the function of the pistol especially when using the shorter nosed match ammunition used in competition.

Some semiautomatic firearms like the M16A4 rifle and M4A1 carbine use aluminum magazines. The aluminum magazines are lighter in weight but are prone to damage from impact to the body of the magazine and deformation of the feed lips. In the case of the M4A1, the short barrel/gas system contributes to increased failure to feed which can be reduced with an increased feed lip angle to allow for a higher presentation of the nose of the round to the chamber for feeding. This increased angle also limits the distortion to the bullet enhancing the accuracy of the firearm. A decreased feed angle, which can be caused by an impact to the feed lips, can increase the frequency of failures to feed due to the rounds impacting the upper receiver below the feed ramp of the barrel extension.

2. Discussion of Prior Art

The die and anvil tool sets previously mentioned are configured to allow the user to use these tools on magazines having a closed bottom like the magazines of the M1911A1 pistol. The user must insert the anvil from the top of the magazine and place a steel dowel through one of the holes in the side of the magazine to hold the anvil in place. The die is placed over the feed lips and struck with a hammer. The die and anvil come together and form release points in the lips of the magazine. Several attempts may have to be made as the die and anvil are not joined in such a way as to align them during use.

It should be clear to the reader that a proper magazine feed lip angle is critical to the proper function of firearms which use a magazine. It should also be clear that a tool that repairs or alters the feed lip angle is necessary to properly maintain/enhance an inventory of magazines. The tool should be configured to properly align the die and anvil during use to minimize the attempts required to complete the process.

Objects and Advantages

One object of our invention is to provide a tool which will consistently alter/repair the feed lips of magazines to a predetermined angle to improve feeding. The preferred embodiment of the invention will be hardened and have a means of keeping the die and anvil in proper alignment to allow for proper forming of the feed lips with only one attempt. The preferred embodiment will also be easily installed/assembled by the user and will require no additional tools, such as a hammer, to apply the force necessary to form the feed lips.

A further object of our invention is to provide a tool that can be configured to fit the inside dimensions of a magazine in such a way that the anvil of the tool will insert from the bottom of the magazine and travel easily to the top of the magazine unless a deformation in the side walls is encountered. The anvil will aid in the detection of deformation of the side walls and will provide a rigid surface with which an armorer, or other user, can utilize a peening hammer/non-marring tool to repair the deformation (dents).

Further objects and advantages of our invention will become apparent from a consideration of the drawings and ensuing description.

BRIEF DESCRIPTION OF THE DRAWINGS

The present invention will now be described further by way of example, with reference the accompanying drawings, in which.

REFERENCE NUMERALS IN DRAWINGS

| | | | | | |
|---|---|---|---|---|---|
| 1 | handle | 8a | rear alignment pin | 15a | rear tab |
| 2 | die | 8b | front alignment pin | 15b | front tab |
| 3 | anvil | 9 | forming radius | 16 | front tab relief |
| 4 | threaded shaft | 10 | front rib relief | 17 | through hole |
| 5 | forward stop | 11 | rear rib relief | 18 | threaded orifice |
| 6 | set screw | 12 | feed lip | 19 | kerf cut |
| 7 | left forming surface | 13 | magazine body | 20a | rear pin hole |
| 7a | right forming surface | 14 | follower stop | 20b | front pin hole |

DESCRIPTION OF THE PREFERRED EMBODIMENT—FIGS. 1 AND 2

Figure 1:
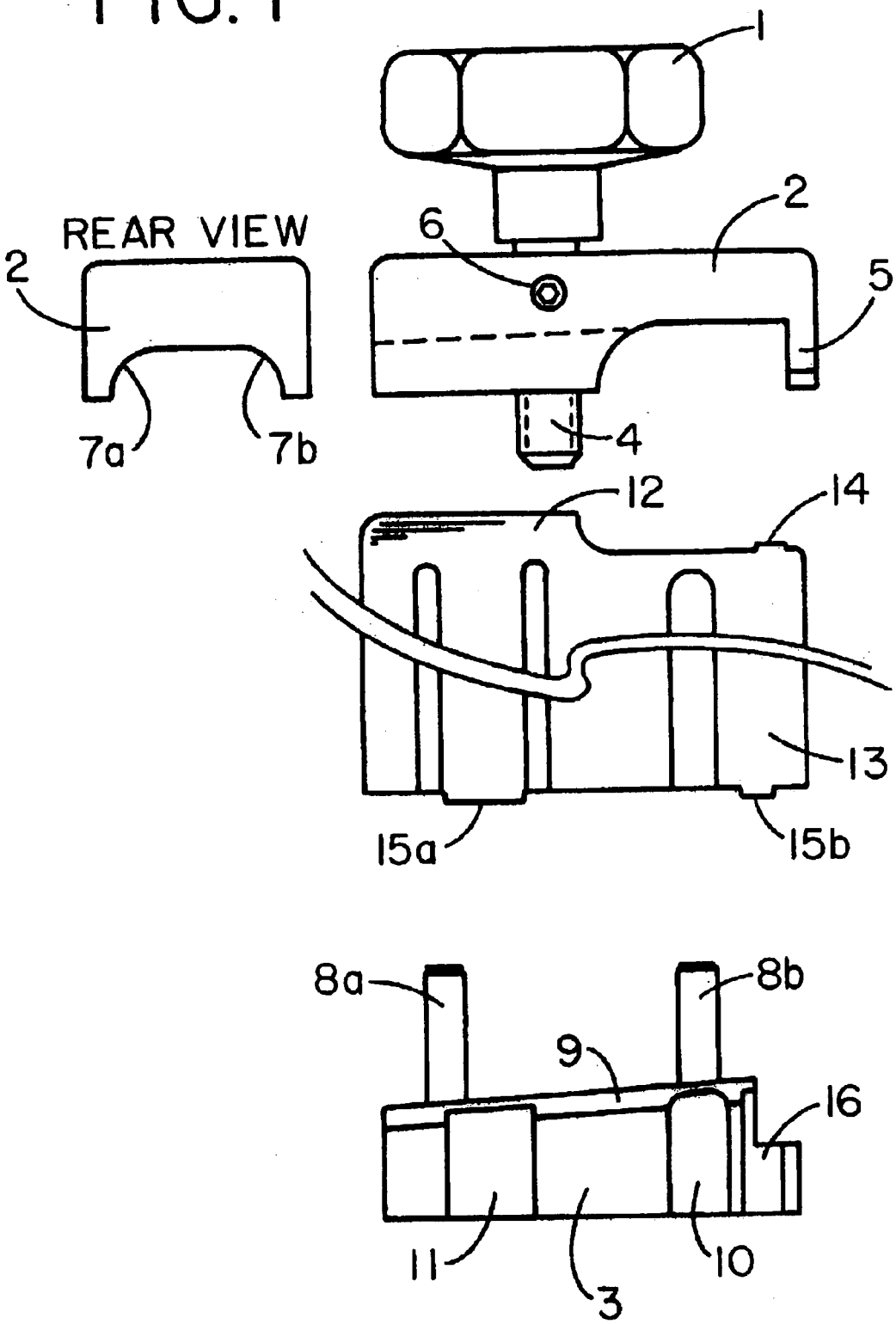
FIG. 1 is a side view of the preferred embodiment disassembled and at either end of a magazine with a partial rear view of the upper portion (die)

FIG. 1 shows the side view of the preferred embodiment separated and positioned above and below a magazine body 13. A handle 1 is rotationally joined to a die 2 by a set screw 6. A rear view of die 2 shows the radii of left forming surface 7*a* and right forming surface 7*b* which are identical to the radius of a magazine feed lip 12 to be altered or repaired. Die 2 is equipped with a forward stop 5 to support die 2 during the forming process. A threaded shaft 4 of handle 1 joins die 2 to an anvil 3 and draws die 2 and anvil 3 together to form feed lip 12.

Anvil 3 is fitted with a rear alignment pin 8*a* and a front alignment pin 8*b* which mate with through holes in die 2 to guide die 2 and anvil 3 and assure proper alignment during the lip forming process. A rear tab relief 11 of anvil 3 provides clearance for a rear tab 15*a* of magazine body 13. A front rib relief 10 of anvil 3 provides clearance for the front rib of magazine body 13. A front tab relief 16 provides clearance for a front tab 15*b* of magazine body 13. Left forming surface 7*a* and aright forming surface 7*b* mate with, and are identical to, the outer radius of feed lip 12 of magazine body 13. This configuration ensures consistent forming of feed lip 12 when die 2 and anvil 3 are drawn together and prevents the possibility of excessive forming of feed lip 12. The forward portion of anvil 3 is configured in such a way as to prevent interference of anvil 3 with a follower stop 14 of magazine body 13.

Figure 2:
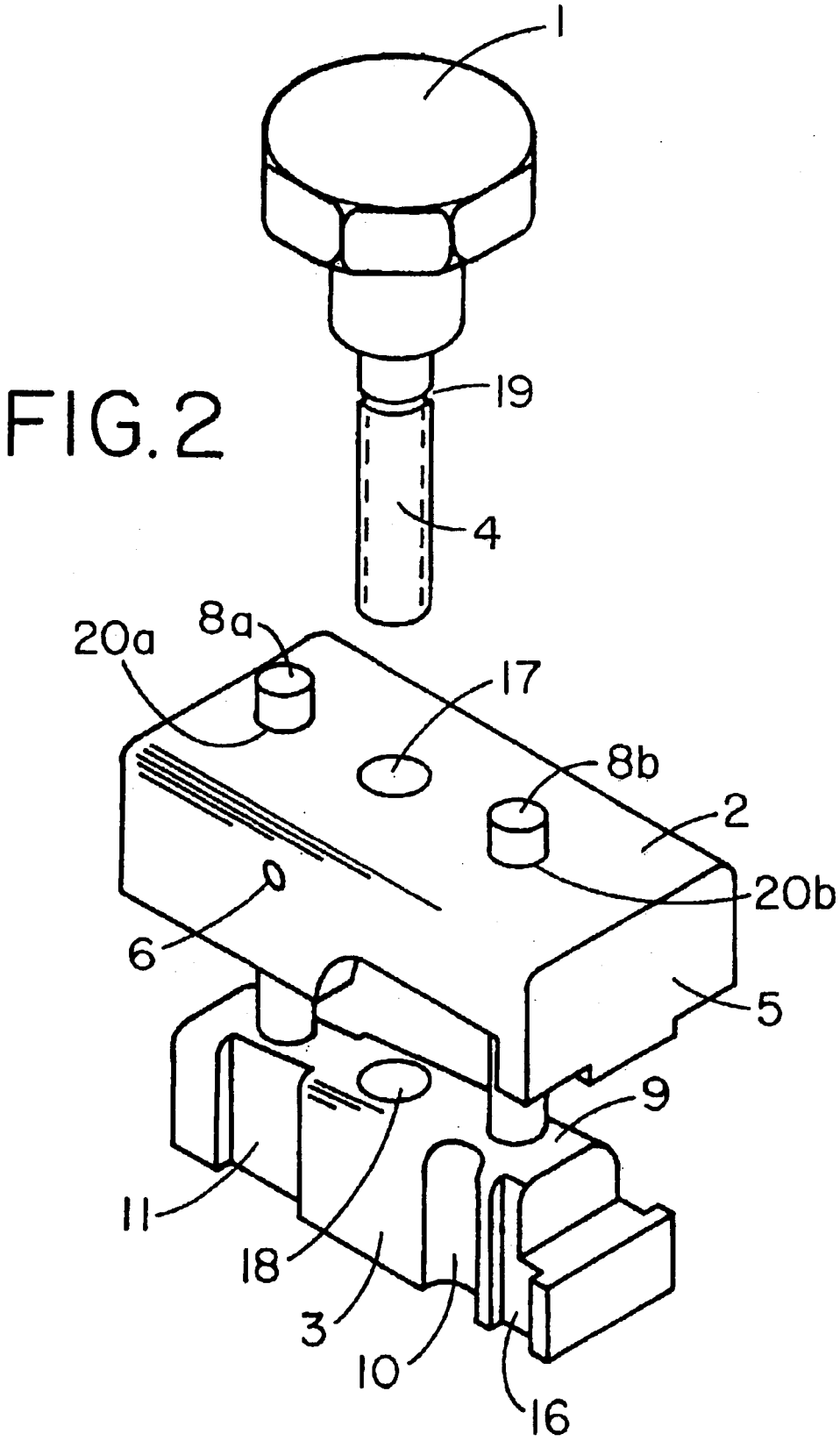
FIG. 2 is a perspective view of the preferred embodiment.

FIG. 2 shows the preferred embodiment joined where rear alignment pin 8*a* and front alignment pin 8*b* protrude through a rear pin hole 20*a* and a front pin hole 20*b* respectively. Threaded shaft 4 of handle 1 rotates within a through hole 17 of die 2 and threaded shaft 4 engages a threaded hole 18 of anvil 3. Set screw 6 of die 2 engages kerf 19 of handle 1 to rotationally join handle 1 and die 2. The clockwise rotation of handle 1 draws die 2 and anvil 3 together. The counterclockwise rotation of handle 1 separates die 2 and anvil 3. Rear alignment pin 8*a* and front alignment pin 8*b* are of a sufficient length to guide die 2 and anvil 3 during the lip forming process but are not long enough to interfere with handle 1 when die 2 and anvil 3 are drawn together to complete the lip forming process. To perform the lip forming task, the user inserts anvil 3 into the base of magazine body 13 (alignment pins first) and inverts magazine body 13 to allow gravity to position anvil 3 feed lip 12 of magazine body 13. The user then pinches the side walls of magazine body 13 directly over anvil 3 to hold it in position to allow for the joining of threaded shaft 14 and threaded hole 18. Handle 1 is rotated clockwise drawing die 2 and anvil 3 together to form the magazine feed lips.

To further improve the feeding of rounds from the magazine, a modification to the typically straight configuration of the magazine spring is beneficial. Forming of the spring to a radius similar to that of the magazine is necessary. The orientation of the curvature of the spring for assembly is opposite that of the curvature of the magazine. In other words, the more open ends of the coils are oriented towards the front of the magazine. This provides more force to the front of the follower, keeping the nose of the rounds high in the magazine, improving feeding While the description above contains many specificities, these should not be construed as limitations on the scope of the invention, but rather as an exemplification of one preferred embodiment thereof. Many other variations are possible.

SUMMARY

It should, therefore, be clear to the reader that the structure of our invention will enable individuals to consistently alter or repair the feed lips of magazines to a predetermined angle to improve feeding. It should also be clear that the structure of our invention allows the user to perform the task of forming the lips of a firearm magazine without additional tools in a field environment. Lastly, the anvil of the preferred embodiment can be utilized to detect and repair damage to the side walls of the magazine.

We claim:

1. A tool for altering a firearm magazine provided with feed lips, comprising:

a die having a surface suitable to forming said feed lips simultaneously to a predetermined angle;

an anvil having a surface that engages said die to form said feed lips when said anvil and said die are drawn together, said anvil having at least one rib relief;

a threaded handle configured to draw said die and said anvil together.

2. A tool according to claim 1, wherein said anvil has at least one tab relief and at least one said rib relief.

3. A tool according to claim 2, wherein said anvil includes one or more pins and said die has one or more holes for accepting said pins for maintaining alignment when said die and said anvil are drawn together.

4. A tool according to claim 1, wherein said anvil includes one or more pins and said die has one or more holes for accepting said pins for maintaining alignment when said die and said anvil are drawn together.

* * * * *